US005481654A

United States Patent [19]

Kikuchi et al.

[11] Patent Number: 5,481,654

[45] Date of Patent: Jan. 2, 1996

[54] OUTPUT CONTROLLER FOR A DOT PRINTER HEAD

[75] Inventors: Narumi Kikuchi; Tsuyoshi Matsushita; Yutaka Wada, all of Shizuoka, Japan

[73] Assignee: Kabushiki Kaisha Tec, Shizuoka, Japan

[21] Appl. No.: 923,540

[22] Filed: Aug. 3, 1992

[30] Foreign Application Priority Data

Aug. 7, 1991 [JP] Japan ..... 3-197704

[51] Int. Cl.[6] ..... B41J 3/12

[52] U.S. Cl. ..... 395/108; 400/124.01

[58] Field of Search ..... 395/114, 112, 395/108, 115, 117; 364/519; 400/124.01

[56] References Cited

U.S. PATENT DOCUMENTS

| | | | |
|---|---|---|---|
| 4,027,761 | 6/1977 | Quaif . | |
| 4,602,880 | 7/1986 | Oba | 400/121 |
| 4,774,882 | 10/1988 | Ohsawa et al. . | |
| 4,833,626 | 5/1989 | Malcolm | 364/519 |
| 5,078,520 | 1/1992 | Yano et al. | 400/124 |
| 5,150,311 | 9/1992 | Lang et al. | 395/108 |
| 5,167,459 | 12/1992 | Yano et al. | 395/108 |
| 5,170,188 | 12/1992 | Bowers et al. | 346/159 |
| 5,268,993 | 12/1994 | Ikenoue et al. | 395/114 |

FOREIGN PATENT DOCUMENTS

| | | |
|---|---|---|
| 0160318 | 11/1985 | European Pat. Off. . |
| 0335257 | 10/1989 | European Pat. Off. . |
| 63-132063 | 6/1988 | Japan . |
| 3-147855 | 6/1991 | Japan . |
| 2212640 | 7/1989 | United Kingdom . |

*Primary Examiner*—Mark R. Powell
*Assistant Examiner*—Steven P. Sax
*Attorney, Agent, or Firm*—Oblon, Spivak, McClelland, Maier & Neustadt

[57] ABSTRACT

A printing mode setting portion outputs energizing time data corresponding to a selected printing mode when selecting the printing mode according to operation of the operation unit. Based on the energizing time data, the energizing time period of a head energizing signal which is output from a head driving portion to a driving coil of a dot printer head is controlled by the energizing time control portion 6. When printing mode having a high dot density is selected, printing energy is reduced and the energizing time period is refined for the driving coil 8, thus making it made possible to lower the noise level.

3 Claims, 3 Drawing Sheets

2
FUNCTION PORTION
4
ROM
5
RAM
PRINTING MODE DATA
3
PRINTING MODE SETTING PORTION
CONTROL PORTION
1
PRINTING DATA
ENERGIZING TIME DATA
6
ENERGIZING TIME CONTROL PORTION
FIRST TIMER
SECOND TIMER
THIRD TIMER
10
11
12
8
9
DOT PRINTER HEAD
7
HEAD DRIVING PORTION

OUTPUT CONTROLLER FOR A DOT PRINTER HEAD

FIELD OF THE INVENTION AND RELATED ART STATEMENT

The present invention relates to an output controller for a doe printer head.

DISCUSSION OF THE BACKGROUND

A dot printer is known in which the printing mode can be selected from a plurality of printing modes having different dot densities such as LQ (letter quality), NLQ (near letter quality), Draft, etc. A printing mode of a highest dot density is LQ, and then, NLQ, and Draft follow in order.

In a conventional printer, even if a printing mode can be selected, printing conditions are constant. Therefore, when a printing mode of a high dot density is selected, the number of times of hits of a needle against a platen per unit time is large, which may cause a problem of a high noise level.

OBJECT AND SUMMARY OF THE INVENTION

A first object of the present invention is to determine the energizing time for a driving coil corresponding to a printing mode selected according to a desired usage.

A second object of the present invention is to keep the noise level low even when the printing mode of the high dot density is selected.

According to the present invention, there is provided an output controller for a dot printer head which prints upon driving a driving coil of a dot printer head by a head driving portion, comprising: an operation unit for selecting a printing mode; a printing mode setting portion for setting the energizing time corresponding to the selected printing mode, being connected to the operation unit; and the energizing time control portion for controlling the energizing time for the driving coil corresponding to the output of the printing mode setting portion.

Therefore, when a printing mode of a high dot density is selected, it is possible to make the printing energy small by making the energizing time period short, and thereby it is made possible to lower the noise level by the arrangement in which the printing mode setting portion is made to output the energizing time data corresponding to the printing mode by selecting the printing mode in operating the operation unit, and based on the energizing time data, the energizing time of the energizing signal, which is output from the head driving portion to the driving coil of the dot printer head is controlled by the energizing time control portion.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF PREFERRED EMBODIMENT

Figure 1:
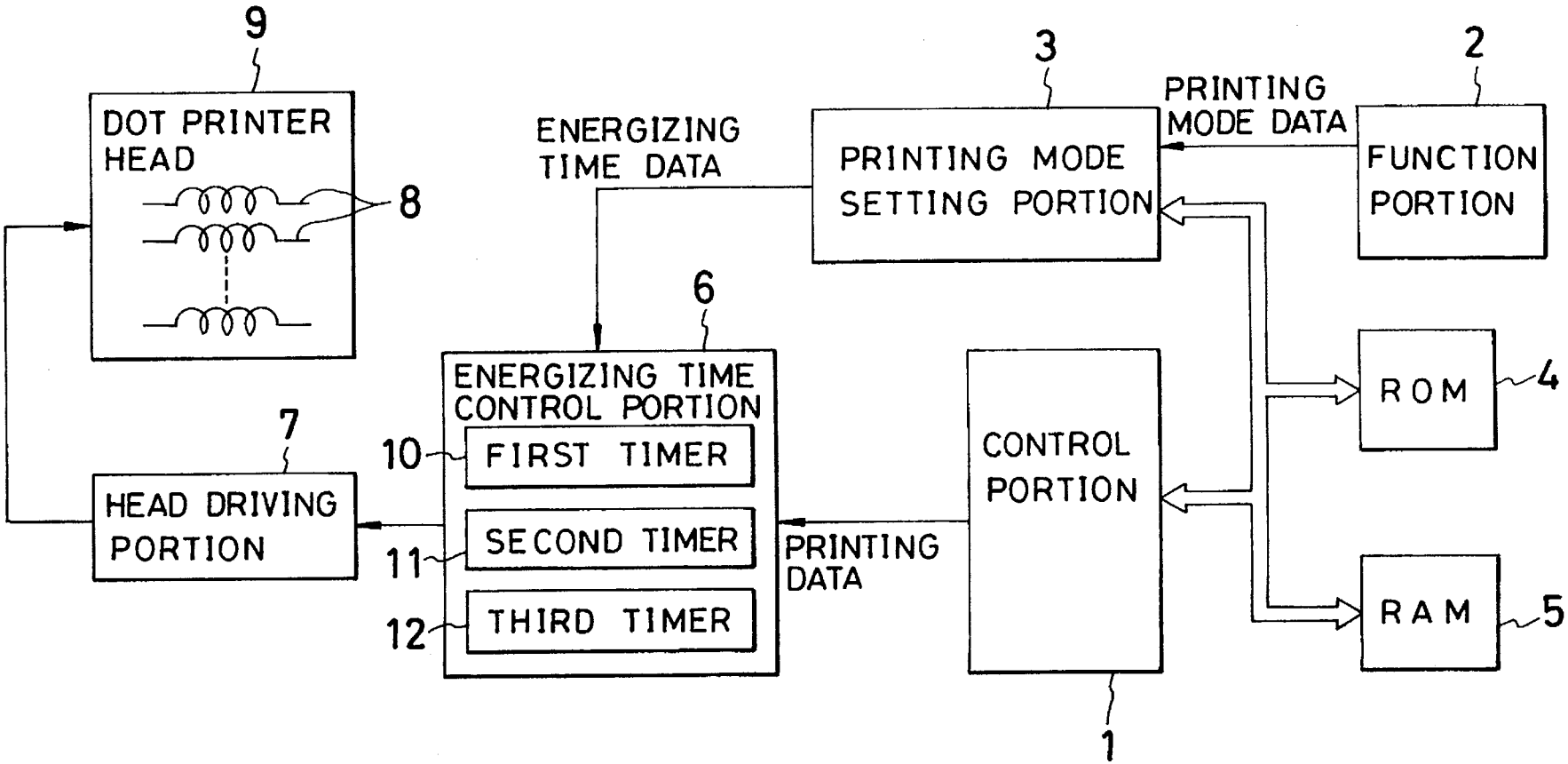
FIG. 1 is a block diagram showing an electronic circuit.

A preferred embodiment according to the present invention will be explained referring to the drawings. As shown in FIG. 1, a bus line connects a control unit 1 composed of a CPU, etc., a printing mode setting portion 3 connected to an operation unit 2 for selecting a printing mode from a plurality of printing modes having different kinds of dot densities such as LQ (letter quality), NLQ (near letter quality) or Draft, a ROM 4 on which program data are written, and a RAM 5 on which variable data are written. A head driving portion 7 is connected to the output side of an energizing time control portion 6 to which printing data from the control unit 1 and an energizing time data set in the printing mode setting portion 3 are to be input, and there is provided a dot printer head 9 having a plurality of driving coils 8 which make needles hit a platen being driven by the head driving portion 7. The energizing time control portion 6 comprises a first timer 10, a second timer 11 and a third timer 12.

In the constitution as described in the above, the operation will be explained referring to a flow chart shown in FIG. 4. When the printing mode is selected from LQ, NSQ, Draft, etc. by operating the operation unit 2, the energizing time which makes the head driving portion 7 output an head energizing signal to the driving coil 8 corresponding to a selected printing mode is set by the printing mode setting portion 3. The energizing time period is set by being divided into a continuous energizing time period Ta, an on-pulse width period Tb in a chopper driving time and an off-pulse width Tc in a chopper driving time as shown in FIGS. 2 and 3, and the continuous energizing time Ta is set in the first timer 10 of the energizing time control portion 6, the on-pulse width Ta in the chopper driving time is set in the second timer 11, and the off-pulse width Tc in the chopper driving time is set in the third timer 12.

On the other hand, the control unit 1 reads out the printing data (dot data) from a character generator in the ROM 4 corresponding to a character code transmitted from a host computer, and outputs the data to the head driving portion 7 through the energizing time control portion 6; in this case, the energizing time period of the head energizing signal which is output to the driving coil 8 from the head driving portion 7 is controlled by the energizing time control portion 6. The first timer 10 of the energizing time control portion 6 counts the continuous energizing time period Ta, the second timer 11 counts the on-pulse width Tb in a chopper driving time period, and the third timer 12 counts the off-pulse width Tc in a chopper driving time period. When these counted values reach the set values, the head driving portion 7 cuts off energizing the driving coil 8.

Figure 2:
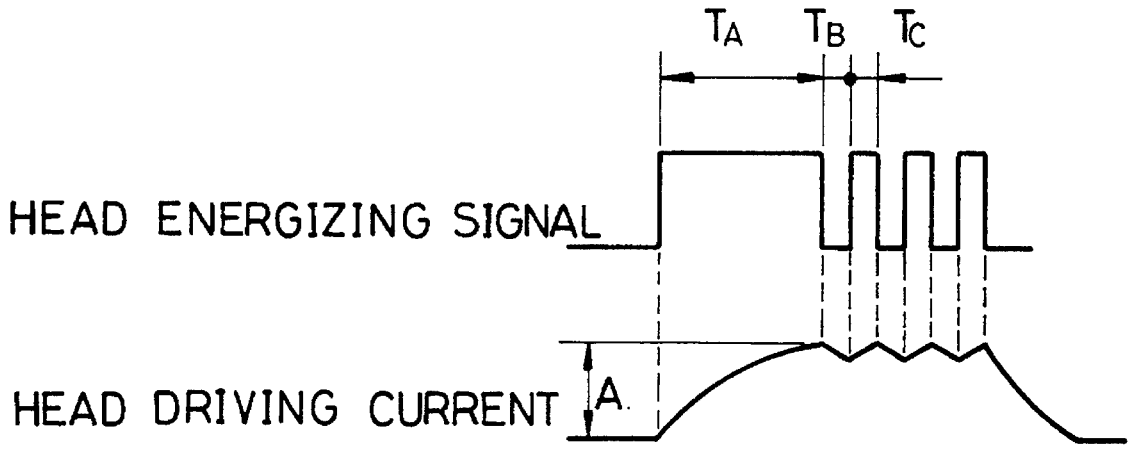
FIG. 2 is a timing chart showing the relation between a head energizing signal and a head driving current when a Draft printing mode is selected.
Figure 3:
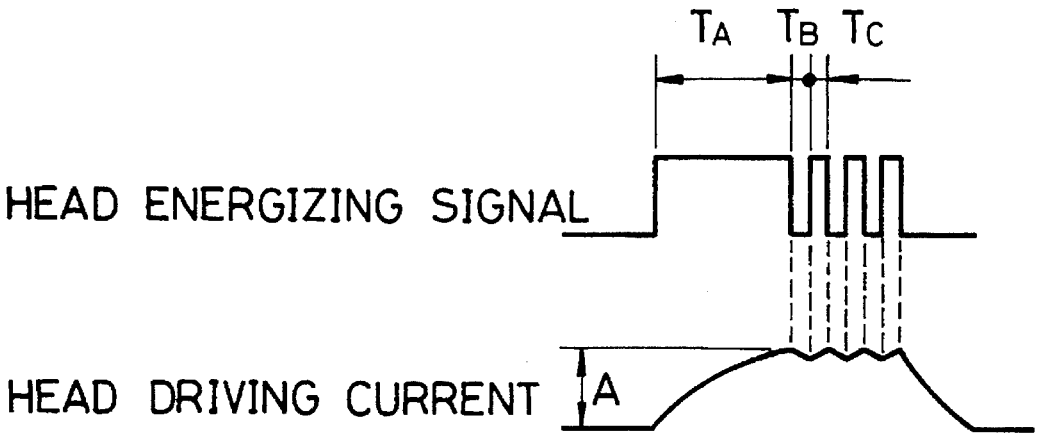
FIG. 3 is a timing chart showing the relation between a head energizing signal and a head driving current when an LQ printing mode is selected.
Figure 4:
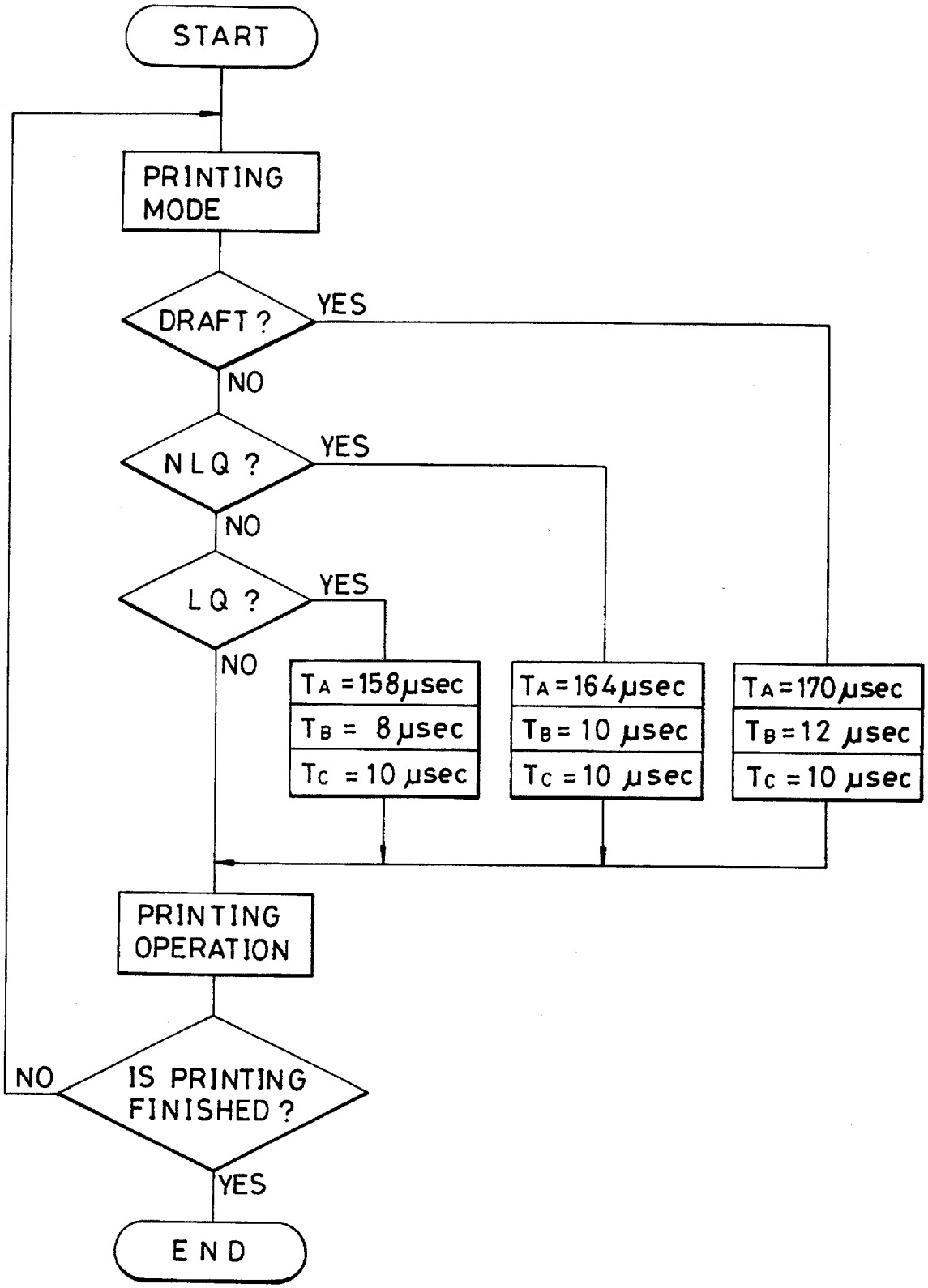
FIG. 4 is a flow chart.

FIG. 2 is a timing chart showing the relation between the head energizing signal and the head driving current A when the Draft printing mode is selected, and FIG. 3 is a timing chart showing the relation between the head energizing signal and the head driving current A when the LQ printing mode is selected; the noise in a printing time can be decreased by making the printing energy per dot small and by making the energizing time for a printing mode having a high dot density LQ in the printing mode shorter than the energizing time for a Draft printing mode having a low dot density.

According to the present invention as described in the above, in the output controller for the dot printer head which prints upon driving the driving coil of the dot printer head, the operation unit for selecting the printing mode, the printing mode setting portion for setting the energizing time corresponding to the selected printing mode being connected to the operation unit, and the energizing time control portion for controlling the energizing time of the driving coil according to the output of the printing mode setting portion are provided, so that when a printing mode of a high dot density is selected, the printing energy can be reduced by decreasing the energizing time. Consequently the noise level can be lowered, due to an arrangement in which the printing mode setting portion is made to output energizing time data corresponding to the printing mode in selecting the printing mode according to a usage by operating the operation unit, and based on the energizing time data, the energizing time of the head energizing signal which is output from the head driving portion to the driving coil of the dot printer head is controlled by the energizing time control portion.

What is claimed is:

1. An output controller for a dot printer head executing printing by use of a driver coil of a dot printer head operated by head driving portion, which comprises:

an operation unit selecting a printing mode;

a printing mode setting portion setting an energizing time period corresponding to the pre-selected printing mode and being connected to the operation unit; and an energizing time control portion controlling the energizing time period for the driving coil corresponding to the output of the printing mode setting operation wherein the energizing time period is set by being divided by the printing mode setting portion into a continuous energizing time period Ta, an on-pulse width Tb in a chopper driving time period, and an off-pulse width Tc in a chopper driving time period and wherein the energizing time control portion includes a first, second and third timer which respectively count the continuous energizing time Ta, the on-pulse width Tb and the off-pulse width Tc such that, when the counted values thereof reach set values in a high dot density mode, the head driving portion cuts off energizing of the driving coil so as to reduce noise.

2. An output controller for a dot printer head executing printing by use of a driver coil of a dot printer head operated by head driving portion, which comprises:

an operation unit selecting a printing mode;

a printing mode setting portion setting an energizing time corresponding to the pre-selected printing mode and being connected to the operation unit; and an energizing time control portion controlling the energizing time period for the driving coil corresponding to the output of the printing mode setting operation wherein the continuous energizing time period Ta, the on-pulse width Tb in the chopper driving time, and the off-pulse width Tc in the chopper driving time are individually separately set by the printing mode setting portion and wherein the energizing time control portion includes a first, second and third timer which respectively count the continuous energizing time Ta, the on-dash pulse width Tb and the off-pulse width Tc such that, when the counted values thereof reach set values in a high dot density mode, the head driving portion cuts off energizing of the driving coil so as to reduce noise.

3. An output controller for a dot printer head executing printing by use of a driver coil of a dot printer head operated by head driving portion, which comprises:

an operation unit selecting a printing mode;

a printing mode setting portion setting an energizing time corresponding to the pre-selected printing mode and being connected to the operation unit; and an energizing time control portion controlling the energizing time period for the driving coil corresponding to the output of the printing mode setting operation wherein the energizing time control portion comprises a plurality of timers in the printing mode setting portion setting the continuous energizing time period Ta, the on-pulse width Tb in the chopper driving time, and the off-pulse width Tc in the chopper driving time and wherein the plurality of timers includes a first, second and third timer which respectively count the continuous energizing time Ta, the on-pulse width Tb and the off-pulse width Tc such that, when the counted values thereof reach set values in a high dot density mode, the head driving portion cuts off energizing of the driving coil so as to reduce noise.

* * * * *

UNITED STATES PATENT AND TRADEMARK OFFICE

CERTIFICATE OF CORRECTION

PATENT NO. : 5,481,654

DATED : Jan. 2, 1996

INVENTOR(S) : Narumi KIKUCHI, et al.

It is certified that error appears in the above-indentified patent and that said Letters Patent is hereby corrected as shown below:

On the title page, Item [73], the assignee, should read:

--Kabushiki Kaisha TEC, Shizuoka, Japan--

Signed and Sealed this

Thirtieth Day of April, 1996

*Attest:*

*Attesting Officer*

BRUCE LEHMAN

*Commissioner of Patents and Trademarks*